United States Patent [19]

Reichardt et al.

[11] Patent Number: 4,639,053

[45] Date of Patent: Jan. 27, 1987

[54] CONNECTOR FOR A SHIELDED FLAT CABLE

[75] Inventors: Manfred Reichardt, Weinsberg; Gunter Schutzle, Heilbronn, both of Fed. Rep. of Germany

[73] Assignee: Allied Corporation, Morris Township, Morris County, N.J.

[21] Appl. No.: 797,342

[22] Filed: Nov. 12, 1985

[30] Foreign Application Priority Data

Nov. 15, 1984 [DE] Fed. Rep. of Germany ..... 3441818

[51] Int. Cl.[4] ..... H01R 4/66

[52] U.S. Cl. ..... 339/14 R; 339/17 F; 339/143 R

[58] Field of Search ..... 339/17 F, 176 MF, 98, 339/97 A, 143 R, 14 R; 174/117 F

[56] References Cited

U.S. PATENT DOCUMENTS 3,990,767 11/1976 Narozny ..... 339/198 R
4,404,424 9/1983 King et al. ..... 174/117 F X
4,422,700 12/1983 Krenz ..... 339/176 MF X
4,458,967 7/1984 King et al. ..... 339/143 R X
4,536,045 7/1985 Reichardt et al. ..... 339/14 P
4,537,458 8/1985 Worth ..... 339/17 F X

FOREIGN PATENT DOCUMENTS 2626631 1/1977 Fed. Rep. of Germany .

*Primary Examiner*—Eugene F. Desmond
*Attorney, Agent, or Firm*—Roger H. Criss

[57] ABSTRACT

A connector for a shielded flat cable (1) the connector having a connector housing (13) with an insulating body (15) arranged within the housing and a grounding sheet metal spring (20) contacting the shield (40) of the cable. The grounding sheet metal spring is formed and arranged in the connector housing in such a manner that the shield of the flat cable is directly contacted by the grounding sheet metal spring on one of the wide sides of the flat cable, and that, on the other hand, the grounding sheet metal spring urges the shield on the other wide side of the flat cable against a grounded component of the connector.

18 Claims, 10 Drawing Figures

CONNECTOR FOR A SHIELDED FLAT CABLE

BACKGROUND OF THE INVENTION

1. Field of the Invention

The invention relates to a connector for a flat cable which is provided with a shield. In particular, the invention relates to a connector for a flat cable having shield means formed by two shielding foils.

2. Description of the Prior Art

So as to effectively shield the conductors of a flat cable by the shield provided in the flat cable, it is required that the shield be connected to the ground. This connection of the shield of the flat cable with ground is, for instance, effected by means of an uninsulated ground wire which coextends together with the shield. This ground wire can be connected to a grounded component of a connector, for instance, one of the contacts of the connector. Generally speaking, screw means are used for connecting the shield of a flat cable, which is shielded all around, to a connector housing made of metal.

German Offenlegungsschrift No. 34 33 000.3, filed Sept. 7, 1984 already suggests shield termination means which can be made effective without having to use a tool. According to the teaching of this patent applicaation a metallic bracket is placed on one of the shielding foils and resiliently contacts with its arms the grounded inner wall of the housing. Particularly for a flat cable where the shield comprises two shielding foils, one of which extending substantially along the one wide side, the other of which extending substantially along the other wide side of the flat cable, the contacting provided for by said German Offenlegungsschrift frequently does not provide for a sufficient amount of attenuation.

It would be desirable to provide a connector for a shielded flat cable in such a manner that an increase in the amount of attenuation is achieved.

It would also be desirable to provide a connector with improved attenuation without necessitating the use of tools when connecting the shield of the flat cable with ground.

SUMMARY OF THE INVENTION

In accordance with this invention, there is provided in a connector for a flat cable having shield means, the connector comprising a connector housing; an insulating body adapted to be placed in the housing, the insulating body having a cable termination side and a connector receiving side; a plurality of contacts arranged in the insulating body, the contacts comprising at their end located at the cable termination side contact means for the displacement of the insulation of the flat cable; cable holding means for holding the flat cable in engagement with the insulation displacement contact means and adapted to be mounted on the insulating body; cable strain relief means adapted to urge the flat cable, which is guided in a U-shaped manner about the cable holding means, against the upper side of the cable holding means; and grounding sheet metal means adapted for contacting the shield and for connecting it with a grounded component of the connector, the improvement comprising that the grounding sheet metal means is formed and arranged in the connector housing in such a manner that the shield of the one wide side of the flat cable is directly contacted by the grounding sheet metal means to a grounded component of the connector, and that the grounding sheet metal means urges the shield at the other side of the flat cable against a grounded component of the connector.

Also in accordance with this invention, there is provided a connector for a flat cable having shield means, said connector comprising:

a connector housing;

an insulating body adapted to be placed in the connector housing;

the insulator body having a cable termination side and a connector receiving side;

a plurality of contacts arranged in the insulating body; and grounding sheet metal means adapted for contacting the shield and for connecting it with a grounded component of the connector;

characterized in that the grounding sheet metal means is formed and arranged in the connector housing in such a manner that the shield at the one wide side of the flat cable is directly contacted by the grounding sheet metal means and is connected by means of the grounding sheet metal means to a grounded component of the connector; and that the grounding sheet metal means urges the shield at the other side of the flat cable against a grounded component of the connector.

Further in accordance with the invention a connector is provided which comprises a single grounding element adapted to contact the two wide sides of the shielding foil or, alternatively, the two individual shielding foils, so as to connect the flat cable shielding with one or more grounded components of the connector.

This invention provides a sheet metal component (grounding sheet metal means) which is made of electrically conductive material. The grounding sheet metal means is of resilient design.

Also in accordance with the invention the electrically conductive grounding sheet metal means directly contacts the one shielding foil at the one wide side of the flat cable and is connected with a grounded component of the connector and, moreover, the grounding sheet metal means presses the shielding foil located at the other wide side of the flat cable against a grounded component of the connector.

Preferably, the grounding sheet metal means urges the other shielding foil located on the other wide side of the flat cable against the inner surface of the housing of the connector. For that purpose the connector is metallized at its inner surface or is altogether made of a conductive material.

The connector of the invention shows an improved attenuation due to the fact that the two shielding foils are contacted. It was determined, that the attenuation provided by the shield was increased from approximately 39 dB to approximately 47 dB.

The present invention is particularly useful for connectors of the so-called trapezoidal or "D" type, i.e., connectors having a plurality of contacts arranged in an offset manner in a plurality of rows. Connectors of this type are disclosed for example in German Auslegeschrift No. 26 26 631.

In accordance with a preferred embodiment of the invention the flat cable having an insulated conductor portion is placed with that conductor portion between the insulator body of the connector and a cable holding bracket, whereby the cable extends, generally speaking, in the form of a "U" around the cable holding bracket. If the one leg of the "U" is placed between the cable holding bracket and the insulating body, the other leg of the "U" will extend between the cable holding bracket and a cable strain relief bracket. In the area where the cable strain relief bracket urges the flat cable against the cable holding bracket, the shield is still present at the flat cable and the grounding sheet metal means are preferably placed between the cable strain relief bracket and the cable holding bracket.

The flat cable forms besides the above-mentioned "U" another "U" which starts with its one leg between the cable strain relief bracket and the cable holding bracket, the outer insulation being removed and the shield being supported by the flat cable. The bight portion of said second "U" is placed adjacent to the inner surface of the housing of the connector. The other leg of the second "U" is largely covered by the outer insulation and extends parallel to the two legs of the first-mentioned "U" to extend eventually out of the housing of the connector. The grounding sheet metal means is designed such that they urge the bight portion of the second "U" against the inner wall of the housing. The inner wall of the housing preferably forms a grounded component of the connector. Therefore, the one shielding foil is effectively grounded.

On the other hand, the grounding sheet metal means is in direct contact with the other shielding foil and is further connected with another grounded component of the connector. Preferably the grounding means is located against the inner surface of the housing of the connector, a surface which is grounded.

The grounding means is preferably provided in the form of grounding sheet metal means, the sheet metal means preferably having a width equal to the width of the flat cable. The grounding sheet metal means comprises a shape which corresponds to the second "U", at least in the area of the flat cable where the outer insulation of the flat cable is removed. The grounding sheet metal means extends with its end opposite to the "U"-shaped end towards the inner wall of the connector housing, so as to provide at that place the required grounding effect, while at the same time providing the required support, so that the grounding sheet metal means is in a position to preferably urge with its other end the bight portion of the second "U" against the inner wall of the housing, a wall which is preferably metallized.

DESCRIPTION OF THE PREFERRED EMBODIMENTS

Figure 1:
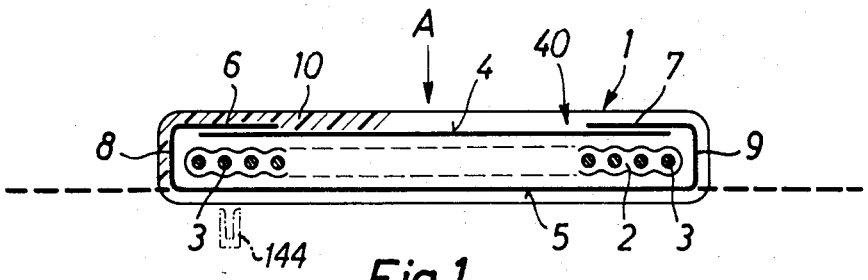
FIG. 1 is a schematic cross-section through a conventional flat cable.
Figure 2:
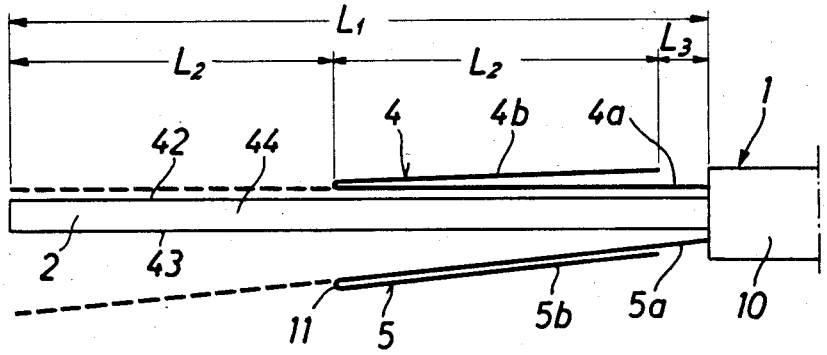
FIG. 2 is a schematic side-view of a flat cable with the outer insulation (cover) being removed and disclosing schematically how in accordance with the invention the shielding foils forming the shield are folded.
Figure 3:
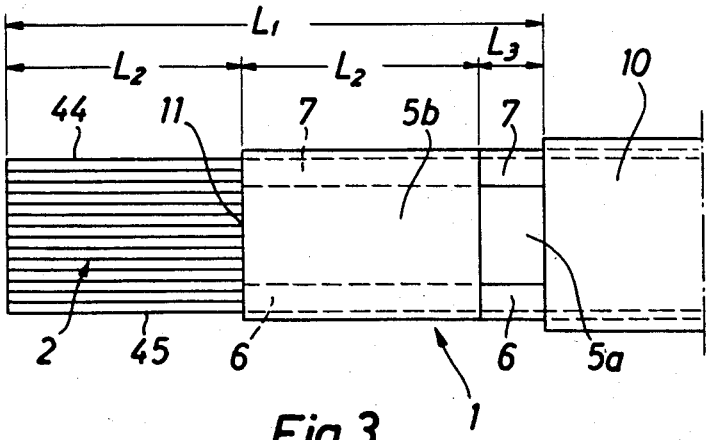
FIG. 3 is a top view of the flat cable, substantially in direction of arrow A in FIG. 1 with the shielding foils being folded as shown in FIG. 2.

FIGS. 1 to 3 represent a flat cable 1, a flat cable which is prepared in accordance with the invention for being terminated by means of a connector 101, 102 or 103.

The flat cable 1 comprises a row of conductors generally made of copper and insulated by an insulation 2 which generally consists of plastic material. The insulation 2 will also be referred to as the conductor part of the flat cable. The conductor part 2 is surrounded by a shield 40. In general, a cable cover 10 is extruded onto shield 40. FIG. 1 also shows schematically in dotted lines an insulation displacement contact 144, which is referred to below.

The shield 40 can be designed in different ways. According to the design shown in FIGS. 1 and 2 the shield 40 comprises a first or upper shield portion 4 and a second or lower shield portion 5. Also according to the design of FIGS. 1 and 2 the upper shield portion 4 as well as the lower shield portion 5 each comprise a shield foil. As shown, the upper shield portion 4 extends approximately across the entire width of the conductor part 2, while the lower shield portion 5 extends across the entire width of the conductor portion and also overlaps sideways a part of the upper shield portion 4. Those parts of the lower shield portion 5 which are arranged in the area of the side-edges 8 and 9, respectively, of the lower shield portion. Adjacent to the side-edges 8 and 9 are overlapping shield portions 6 and 7. The present invention is particularly useful for a flat cable 1 having a shield 40 of the type as shown.

FIGS. 2 and 3 show the preparation to be made according to the invention to the flat cable 1, so as to terminate it by means of a connector. First of all, the cable cover (outer insulation) 10 of the flat cable is removed for a length L1 of the cable. Thereupon (see specifically the bottom view of FIG. 3) the overlapping shield portions 6 and 7 are folded such that they are placed onto the lower shield portion 5. Thereupon (see the schematic representation in FIG. 2) a length L2 of the upper shield portion 4 and also a length L2 of the lower shield portion 5 are folded in the direction of the longitudinal axis of the flat cable. Therefore, regarding the upper shield portion 4, a folded shield portion **4*b* is placed on the not folded shield portion 4*a*. Similarly, a folded shield portion 5*b* is placed on a not folded shield portion 5*a***.

The length L2 is generally selected such that a certain length of L3 remains, a length L3 which defines an area where no folded shield portion is placed. The folded edge of shield portion 5 is referred to by the reference numeral 11.

Moreover, 42 and 43, respectively, relate to the upper and lower wide side, respectively, of the conductor part 2, and 44 and 45, respectively, refer to the two side edges of the conductor part 2.

Figure 4:
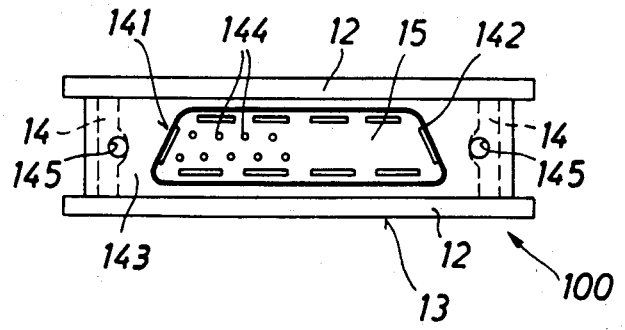
FIG. 4 is a view onto the mating side of a flat cable connector of the trapezoidal type which can be designed in accordance with the invention.

FIG. 4 represents a connector 100 for a flat cable. A connector of this type is called a trapezoidal or "D" connector. In FIG. 4 a connector housing 13 can be seen as comprising two broad side walls 12 and two narrow side walls 14. The upper end 25 of the housing, which is shown for instance in FIG. 5, naturally cannot be seen in FIG. 4. The connector 100 further comprises a metal frame portion 141 which consists of a metal plate 143 and a substantially trapzeoidal metal frame 142 formed on the metal plate 143. The metal frame 142 defines an opening in which an insulating body 15 is shown. The insulating body 15 carries a plurality of contact pins 144 arranged in an offset manner in two rows. Two bores 145 are provided in the metal plate 143 adapted to receive mounting means, so that the metal frame portion 141 can be mounted on the connector housing 13.

Figure 5:
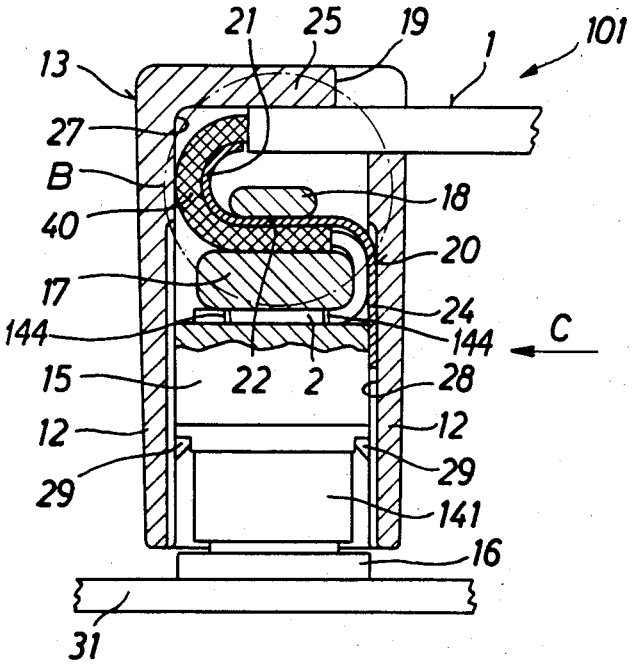
FIG. 5 is a schematic cross-sectional view of a connector in accordance with a first embodiment of the invention.
Figure 6:
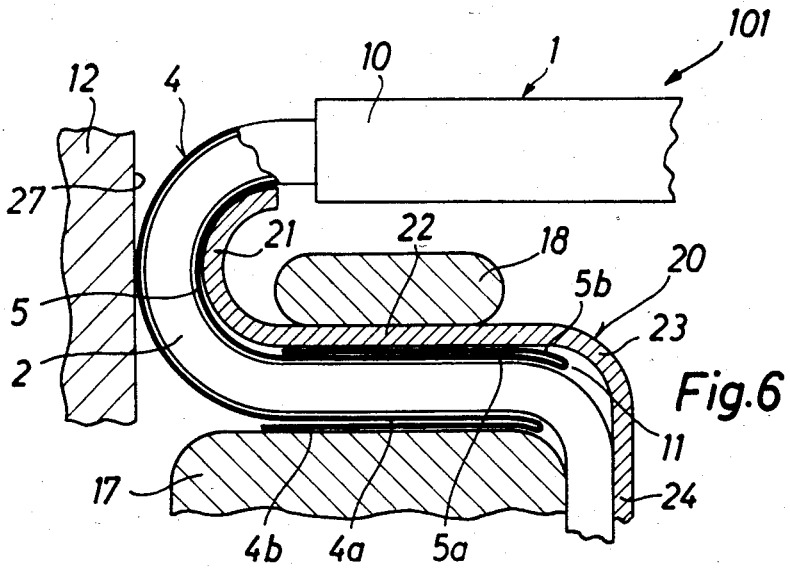
FIG. 6 is a detail of the connector of FIG. 5 approximately in the area B in FIG. 5.
Figure 7:
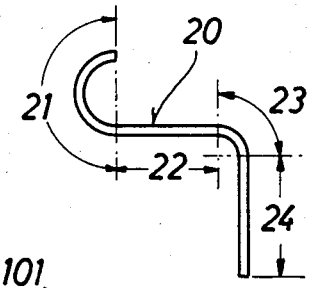
FIG. 7 is an electrically conducting sheet metal means designed in accordance with the invention.

FIGS. 5 to 7 disclose a first embodiment of a connector 101 of the invention, a connector which is, for example, of the type shown in FIG. 4. Therefore, reference is made to the description of FIG. 4.

The connector 101 comprises a connector housing 13 defining two broad side walls 12 and an upper end 25. An opening 19 is provided in one of the broad side walls 12 for admitting a flat cable 1 to the inner space defined by the connector housing 13. Mounting means 29 are formed at the broad side walls 12 and are used for mounting an insulating body 15 already mentioned in connection with FIG. 4. On a plate 31 a connector 16 is shown which is adapted to mate with the connector 101.

As is known in the art, a cable holding bracket 17 is adapted to urge or press the conductor part 2 of the flat cable into the insulation displacement contacts (IDC) 144 which are located in the insulating body 15 so as to provide for the required contact to the conductors 3 of the flat cable. Also, a cable strain relief bracket 18 is provided for urging the flat cable against the cable holding bracket 17. Both the cable strain relief bracket 18 as well as the cable holding bracket 17 may be mounted on the insulating body 5 by detent means. For a connector 101 described so far the invention provides a grounding means in the form of an electrically conducting sheet metal component 20 in such a manner that the shield portion 4 as well the shield portion 5 are effectively grounded. The conducting sheet metal portion 20, referred to below as grounding sheet metal means, is formed and arranged such that it contacts and grounds the one shield portion and urges the other shield portion against a connector component which is in turn grounded. As may be seen in FIGS. 5–8, the resilient grounding sheet metal means 20 contacts, on the one hand, the shield portion 5 directly and presses, on the other hand, the shield portion 4 against the inner surface 27 of the broad side wall 12 which is grounded. For instance, the entire housing 13 could be made of metal, or, if the housing 13 is made of plastic material, then the inner surfaces of the housing, in any event the inner surface 27 of the broad side wall, is metallized.

In case that the housing 13 is made of plastic material, it is preferred that also the inner surface 28 of the other broad side wall is metallized, in particular the entire inner surface of the housing is metallized.

The grounding sheet metal means is shown specifically in FIG. 7 and has a width substantially equal (see FIG. 8) to the width of the conductor part 2 of the flat cable and comprises four sections: a substantially U-shaped or semicircular-shaped end portion 21, adjacent thereto a substantially straight middle portion 22, adjacent thereto a 90° angle portion 23 which continues in the form of a straight end portion 24.

Figure 8:
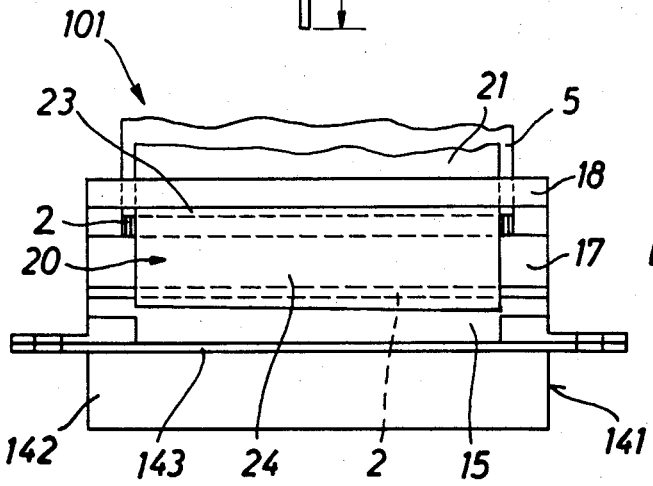
FIG. 8 is a schematic side-elevational view of the lower portion of a connector shown in FIG. 5 approximately in the direction of arrow C in FIG. 5 with the housing being deleted.

In FIGS. 5 and 6 and also in FIG. 8, it can be recognized that the grounding sheet metal means 20 urges with its end portion 21 the flat cable with its shield 40, in fact the upper shield portion 4, against the inner surface 27 of the wall 12. The straight middle portion 22 is placed between the cable strain relief bracket 18 and the cable holding bracket 17 such that the middle portion 22 is placed on the lower shield portion 5 which faces upwardly. The end portion 24 is placed between the conductor part 2 extending around a cable holding bracket 17 and the inner surface 28 of the side wall 12. Preferably, the inner surface 28 of the broad side 12 is, as already mentioned, metallized so that the end portion 24 will provide for a grounding effect of the shield portion 5. It is obviously necessary that the inner surface 28 has to be appropriately connected to ground, for instance by providing a connection to the metal frame member 141. The metal frame member 141 is in turn grounded, for instance by being brought into mating contact with the mating connector. What was said for inner surface 28 is similarly true for the inner surface 27.

It should be noted that it is also conceivable that no metallization of the inner surface 28 is provided and that the end portion 24 is grounded by means of a connection of the end portion with the metal frame member 141. This would, however, yet require a grounding means for the inner surface 27 so as to provide for a grounding effect for the upper shield portion 4.

Even though FIGS. 5 and 6 relate basically to the same embodiment, the following differences should be noted. FIG. 5 discloses an embodiment according to which the conductor part 2 is freed from its shield by removing the undesired shield along a length L2 (said length L2 is shown in FIGS. 2 and 3). FIG. 6, however, refers to the embodiment of a connector 101 where—as shown in FIGS. 2 and 3—the overlapping shield portions 6 and 7 are folded, whereupon then the folded shield portions 4*b*, 5*b* and also folded.

The grounding sheet metal means 20 preferably has a springy or resilient characteristic and may therefore be called a sheet metal spring. It is due to this springy characteristic that the grounding sheet metal means 20 presses the coverless flat cable 1 with its shield 40, preferably with the one shield portion 4, against the metallized inner surface 27, with the result of an excellent grounding effect for the shielding portion 4. On the other hand, the grounding sheet metal means 20 forms with its end portion 24 as well as with the portions 21 and 22 a good contact with the lower shield portion 5, so as to provide an excellent grounding effect also for said latter shield portion 5.

Figure 9:
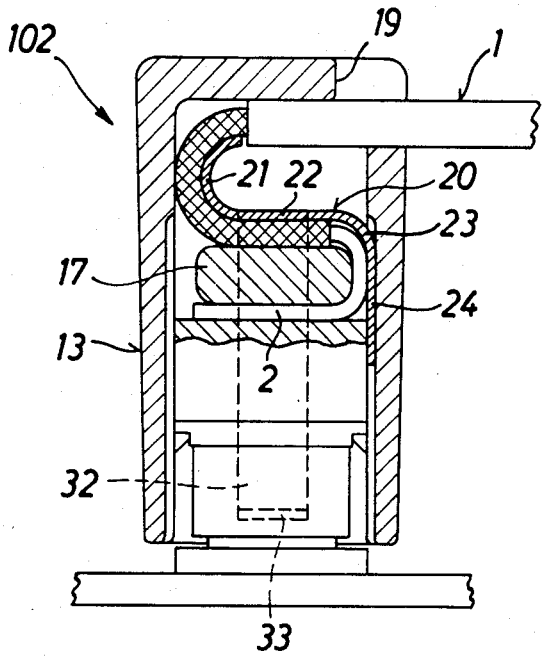
FIG. 9 is a schematic cross-sectional view similar to the cross-sectional view of FIG. 5, but showing another embodiment of the invention.

In FIG. 9 another embodiment of a connector 102 of the invention is disclosed which is of basically the same design as the connector shown in FIG. 5. Therefore reference is made to the description above. In contrast to the embodiment of FIG. 5, the connector of FIG. 9 does not require a cable strain relief bracket 18 inasmuch for the embodiment of FIG. 9 the grounding sheet metal means 20 will also carry out the function of the cable strain relief bracket. For this purpose, the middle portion 22 is provided at its two diametrically opposide side ends with arms 32. Each of said arms 32 is provided at its respective bottom end with detent ribs 33 which can be brought into engagement with the connector. By means of said engagement, the grounding sheet metal means 20 will be tightly drawn towards the cable holding bracket 17. Preferably, the two arms 32 have detent ribs 33 with the same detent contours as the cable holding bracket 18 of the embodiment of FIG. 5 which is made of plastic material, so as to provide for the same kind of mounting for the two arms 32. The grounding of the two shield portions 4 and 5 is provided in the same manner as shown for the embodiments of FIG. 5.

Inasmuch as the two arms 32 are preferably made of metal, they can also be used for grounding purposes, at least for grounding the one shield portion 5.

Figure 10:
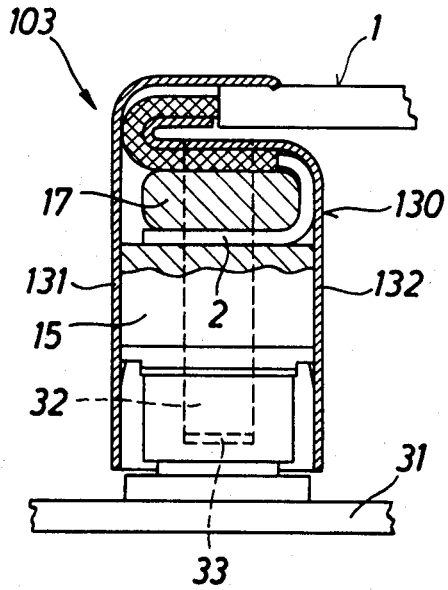
FIG. 10 is a schematic cross-sectional view similar to FIG. 5 showing another embodiment of a connector of the invention.

FIG. 10 discloses another embodiment of a connector 103 of the invention. As far as possible, similar reference numerals were used for components similar to those in the preceding embodiments. Therefore, reference is made in this respect to the earlier description. The connector 103 comprises a housing 130 made of metal. The housing 130 further comprises two halves, housing half 131 and another housing half 132. The housing half 132 forms at the same time the grounding sheet metal means and consequently has substantially the shape of the grounding sheet metal means 20 shown in FIG. 5. The embodiment of FIG. 10 provides for two arms 32 similar to the arms 32 shown for the embodiment of FIG. 9. The arms 32 of the embodiment of FIG. 10 are provided with detent ribs 33 for providing the necessary engagement similar to the (not shown) arms of the cable holding bracket 17 of FIG. 5, so as to urge the housing half 132 with its horizontal portion against the cable 1 and against the cable holding bracket 17.

This invention thus provides a connector for a shielded flat cable having a connector housing with an insulating body arranged within the housing and a grounding sheet metal means contacting the shield of the cable, wherein the grounding sheet metal means is formed and arranged in the connector housing in such a manner that the shield of the flat cable is directly contacted by said grounding sheet metal means on one of the wide sides of the flat cable, and that, on the other hand, the grounding sheet metal means urges the shield on the other wide side of the flat cable against the connector. As a result, the shielding effect is increased without the need for special tools to connect the shield of the flat cable to the ground.

What is claimed:

1. A connector for a flat cable having shield means, said connector comprising:

a connector housing;

an insulating body adapted to be placed in said connector housing;

said insulating body having a cable termination side and a connector receiving side;

a plurality of contacts arranged in said insulating body;

said contacts comprising at their end located at the cable termination side contact means for the displacement of the insulation of the flat cable;

cable holding means for holding the flat cable in engagement with said insulation displacement contact means and adapted to be mounted on the insulating body;

cable strain relief means adapted to urge the flat cable which is guided in a U-shaped manner about the cable holding means against the upper side of the cable holding means; and grounding sheet metal means adapted for contacting said shield and for connecting it with a grounded component of the connector;

characterized in that the grounding sheet metal means if formed and arranged in the connector housing in such a manner that the shield at one wide side of the flat cable is directly contacted by said grounding sheet metal means and is connected by means of said grounding sheet metal means to a grounded component of the connector; and that the grounding sheet metal means urges the shield at the other wide side of the flat cable against a grounded component of the connector.

2. The connector of claim 1 wherein said shield is folded over itself on both sides of said flat cable.

3. The connector of claim 1 in which the flat cable shield comprises two shield portions and wherein the grounding sheet metal means contacts and grounds the one shield portion directly and urges the other shield portion against a grounded inner surface of the connector housing.

4. The connector of claim 3 wherein the grounding sheet metal means is a sheet metal spring.

5. The connector of claim 4, wherein the grounding sheet metal means has a width substantially equal to the width of the flat cable.

6. The connector of claim 5, wherein the grounding sheet metal means comprises two differently formed ends, one end being in engagement with a wide side of the flat cable carrying the said one shield portion and urging the shield portion located on the other wide side of the cable against a grounded component of the connector.

7. The connector of claim 1 wherein the cable holding means comprise a cable holding bracket.

8. The connector of claim 7 wherein the cable strain relief means comprise a cable strain relief bracket.

9. The connector of claim 8 wherein the cable strain relief bracket and/or the cable holding bracket are mounted at the two opposite narrow sides of the insulating body.

10. The connector of claim 8, wherein the grounding sheet metal means comprises a middle portion between two end portions, said middle portion being arranged between the cable holding bracket and the cable strain relief bracket.

11. The connector of claim 10, wherein the cable strain relief bracket is placed immediately on the grounding sheet metal means, said grounding sheet metal means in turn being placed on said one shield portion while the oppositely arranged other shield portion is pressed against the cable holding bracket.

12. The connector of claim 11 wherein one end portion of the grounding sheet metal means is of a semicircular cross-section, said middle portion comprising a portion which is contiguous to said end portion and being substantially flat and an angled portion which is contiguous to said flat portion and having substantially the cross-sectional shape of a quarter of a circle, and said angled portion being contiguous to said other end portion which has a planar configuration.

13. The connector of claim 12 wherein said planar portion serves for contacting the inner surface of the connector housing.

14. The connector as set forth in claim 2, wherein the two shield portions are each shield foils.

15. A connector for a flat cable having shield means, said connector comprising:

a connector housing having two side walls connected by an upper end;

an insulating body adapted to be placed in said connector housing;

said insulating body having a cable termination side and a connector receiving side;

a plurality of contacts arranged in said insulating body;

grounding sheet metal means adapted for contacting said shield and for connecting it with a grounded component of the connector;

characterized in that the grounding sheet metal means is a spring member separate from said connector housing and in contact with said cable and being formed and arranged in the connector housing in such a manner that the shield at one wide side of the flat cable is directly contacted by said grounding sheet metal means and is connected by means of said grounding sheet metal means to a grounded component of the connector; and that the grounding sheet metal means urges that shield at the other side of the flat cable against a grounded component of the connector, said spring member having a curved end, a substantially flat intermediate portion and an opposite end which has a planar configuration and which is angled from said intermediate portion, said opposite end being in contact with said one wide side of said flat cable and said curved end being in contact with said other wide side of said flat cable.

16. The connector of claim 15 wherein said contacts comprise at their end located at the cable termination side contact means for the displacement of the insulation of the flat cable, and further including:

cable holding means for holding the flat cable in engagement with said insulation displacement contact means and adapted to be mounted on the insulating body; and cable strain relief means adapted to urge the flat cable, which is guided in a U-shaped manner about the cable holding means, against the upper side of the cable holding means.

17. A connector for a flat cable having shield means, said connector comprising:

a connector housing having two side walls connected by an upper end;

an insulating body adapted to be placed in said connector housing;

said insulating body having a cable termination side and a connector receiving side;

a plurality of contacts arranged in said insulating body;

said contacts comprising at their end located at the cable termination side contact means for the displacement of the insulation of the flat cable;

cable holding means for holding the flat cable in engagement with said insulation displacement contact means and adapted to be mounted on the insulating body; and grounding sheet metal means adapted for contacting said shield and for connecting it with a grounded component of the connector;

characterized in that the grounding sheet metal means is a spring member separate from said connector housing and in contact with said cable and being formed and arranged in the connector housing in such a manner that the shield at one wide side of the flat cable is directly contacted by said grounding sheet metal means and is connected by means of said grounding sheet metal means to a grounded component of the connector;

that the grounding sheet metal means urges the shield at the other wide side of the flat cable against a grounded component of the connector;

said spring member having a curved end, a substantially flat intermediate portion and an opposite end which has a planar configuration and which is angled from said intermediate portion, said opposite end being in contact with said one wide side of said flat cable and said curved end being in contact with said other wide side of said flat cable; and said spring member having arms mounted at two oppositely located side ends of said intermediate portion, each of said arms carrying detent means at its lower end, which detent means can be brought into engagement with the connector, whereby said spring member functions as a cable strain relief means.

18. A connector for a flat cable having shield means, said connector comprising:

a connector housing;

an insulating body adapted to be placed in said connector housing;

said insulating body having a cable termination side and a connector receiving side;

a plurality of contacts arranged in said insulating body;

said contacts comprising at their end located at the cable termination side contact means for the displacement of the insulation of the flat cable;

cable holding means for holding the flat cable in engagement with said insulation displacement contact means and adapted to be mounted on the insulating body;

grounding sheet metal means adapted for contacting said shield and for connecting it with a grounded component of the connector;

characterized in that said housing comprises two metal housing halves, one of said metal housing halves comprising at its upper end said grounding sheet metal means having a curved end, a substantially flat intermediate portion and a portion which extends downwardly to form a side wall of said housing;

said curved end of said grounding sheet metal means being in contact with and urging the shield at one wide side of said flat cable against the other of said metal housing halves;

said downwardly extending portion of said grounding sheet metal means being directly in grounding contact with the shield at the other wide side of said flat cable; and that said intermediate portion of said grounding sheet metal means has two downwardly extending arms adapted for engagement with said connector, whereby a cable strain relief means is provided.

* * * * *